US008653349B1

(12) United States Patent
White et al.

(10) Patent No.: US 8,653,349 B1
(45) Date of Patent: Feb. 18, 2014

(54) SYSTEM AND METHOD FOR MUSICAL COLLABORATION IN VIRTUAL SPACE

(75) Inventors: Christopher P. R. White, Auckland (NZ); Vinnie Vivace, Auckland (NZ); Chih-Kuo Chuang, Auckland (NZ)

(73) Assignee: Podscape Holdings Limited, Auckland (NZ)

( * ) Notice: Subject to any disclaimer, the term of this patent is extended or adjusted under 35 U.S.C. 154(b) by 364 days.

(21) Appl. No.: 13/032,602

(22) Filed: Feb. 22, 2011

Related U.S. Application Data

(60) Provisional application No. 61/306,914, filed on Feb. 22, 2010.

(51) Int. Cl.
*G10H 3/00* (2006.01)

(52) U.S. Cl.
USPC ..... 84/600; 381/119; 84/625; 84/660

(58) Field of Classification Search
USPC ..... 84/600–602, 625, 660; 381/119
See application file for complete search history.

(56) References Cited

U.S. PATENT DOCUMENTS 5,020,101 A * 5/1991 Brotz et al. ..... 379/388.02
5,768,350 A * 6/1998 Venkatakrishnan ..... 379/93.08
6,175,872 B1 * 1/2001 Neumann et al. ..... 709/231
6,212,534 B1 * 4/2001 Lo et al. ..... 715/205
6,353,174 B1 * 3/2002 Schmidt et al. ..... 84/609
6,482,087 B1 * 11/2002 Egozy et al. ..... 463/7
6,490,359 B1 * 12/2002 Gibson ..... 381/119
6,598,074 B1 * 7/2003 Moller et al. ..... 709/204
6,653,545 B2 * 11/2003 Redmann et al. ..... 84/615
6,898,291 B2 * 5/2005 Gibson ..... 381/119
6,898,637 B2 * 5/2005 Curtin ..... 709/231
7,297,858 B2 * 11/2007 Paepcke ..... 84/609
7,405,355 B2 * 7/2008 Both et al. ..... 84/645
7,518,051 B2 * 4/2009 Redmann ..... 84/601
7,649,136 B2 * 1/2010 Uehara ..... 84/610
7,714,222 B2 * 5/2010 Taub et al. ..... 84/600
7,875,787 B2 * 1/2011 Lemons ..... 84/483.2
7,994,409 B2 * 8/2011 Lemons ..... 84/464 R
8,035,020 B2 * 10/2011 Taub et al. ..... 84/600
2001/0007960 A1 * 7/2001 Yoshihara et al. ..... 700/94
2001/0042056 A1 * 11/2001 Ferguson ..... 706/10
2002/0091847 A1 * 7/2002 Curtin ..... 709/231
2002/0095392 A1 * 7/2002 Ferguson et al. ..... 706/10
2002/0165921 A1 * 11/2002 Sapieyevski ..... 709/204
2003/0091204 A1 * 5/2003 Gibson ..... 381/119
2003/0164084 A1 * 9/2003 Redmann et al. ..... 84/615
2004/0240686 A1 * 12/2004 Gibson ..... 381/119
2005/0120865 A1 * 6/2005 Tada ..... 84/600
2005/0173864 A1 * 8/2005 Zhao ..... 273/299
2006/0112814 A1 * 6/2006 Paepcke ..... 84/645
2006/0123976 A1 * 6/2006 Both et al. ..... 84/600
2007/0028750 A1 * 2/2007 Darcie et al. ..... 84/625

(Continued)

*Primary Examiner* — David S. Warren
(74) *Attorney, Agent, or Firm* — Loginov & Sicard; Keri E. Sicard; William A. Loginov

(57) ABSTRACT

A system and method for musical collaboration in virtual space is described. This method is based on the exchange of data relating to position, direction and selection of musical sounds and effects, which are then combined by a software application for each user. The musical sampler overcomes latency of data over the network by ensuring that all loops and samples begin on predetermined temporal divisions of a composition. The data is temporarily stored as a data file and can be later retrieved for playback or conversion into a digital audio file.

11 Claims, 12 Drawing Sheets

(56) References Cited

U.S. PATENT DOCUMENTS

| | | | | |
|---|---|---|---|---|
| 2007/0039449 | A1* | 2/2007 | Redmann | 84/609 |
| 2007/0044639 | A1* | 3/2007 | Farbood et al. | 84/609 |
| 2007/0140510 | A1* | 6/2007 | Redmann | 381/97 |
| 2007/0255816 | A1* | 11/2007 | Quackenbush et al. | 709/223 |
| 2008/0047413 | A1* | 2/2008 | Laycock et al. | 84/477 R |
| 2008/0060499 | A1* | 3/2008 | Sitrick | 84/477 R |
| 2008/0060506 | A1* | 3/2008 | Laycock et al. | 84/645 |
| 2008/0190271 | A1* | 8/2008 | Taub et al. | 84/645 |
| 2008/0201424 | A1* | 8/2008 | Darcie | 709/204 |
| 2008/0215681 | A1* | 9/2008 | Darcie et al. | 709/204 |
| 2008/0264241 | A1* | 10/2008 | Lemons | 84/601 |
| 2008/0271589 | A1* | 11/2008 | Lemons | 84/477 R |
| 2009/0034766 | A1* | 2/2009 | Hamanaka et al. | 381/310 |
| 2009/0070420 | A1* | 3/2009 | Quackenbush | 709/204 |
| 2009/0156179 | A1* | 6/2009 | Hahn et al. | 455/414.1 |
| 2009/0172200 | A1* | 7/2009 | Morrison et al. | 709/248 |
| 2010/0058920 | A1* | 3/2010 | Uehara | 84/609 |
| 2010/0132536 | A1* | 6/2010 | O'Dwyer | 84/609 |
| 2010/0146405 | A1* | 6/2010 | Uoi et al. | 715/756 |
| 2010/0212478 | A1* | 8/2010 | Taub et al. | 84/645 |
| 2010/0216549 | A1* | 8/2010 | Salter | 463/31 |
| 2010/0319518 | A1* | 12/2010 | Mehta | 84/625 |
| 2010/0326256 | A1* | 12/2010 | Emmerson | 84/610 |
| 2011/0219307 | A1* | 9/2011 | Mate et al. | 715/717 |

* cited by examiner

SYSTEM AND METHOD FOR MUSICAL COLLABORATION IN VIRTUAL SPACE

RELATED APPLICATIONS

This application claims the benefit of copending U.S. Provisional Application Ser. No. 61/306,914, filed Feb. 22, 2010, entitled SYSTEM AND METHOD FOR MUSICAL COLLABORATION IN VIRTUAL SPACE, the entire disclosure of which is herein incorporated by reference.

FIELD OF THE INVENTION

This invention relates to mixing music collaboratively in three-dimensional virtual space.

BACKGROUND OF THE INVENTION

The ubiquitous availability of broadband internet in the home along with ever-increasing computer power is driving the use of the internet for entertainment and paving the way for demanding multimedia applications delivered over the internet. This trend has created new opportunities for online collaboration, opportunities that just a few years ago were not possible for both technical and economic reasons. Among the many new types of networked entertainment genres, online musical collaboration holds great potential to overcome the limitations of conventional musical collaboration and appreciation.

For more than 50 years advances in digital technology have enabled musicians and engineers to create new ways to make and perform music. Such advances have resulted in electronic musical instruments (e.g. sound samplers, synthesizers), which offer new opportunities for musical expression and creativity. Musicians can create a musical composition without having to use a single traditional instrument. Instead, electronic musical compositions are assembled out of prerecorded sound samples and computer generated sounds modulated with filters, then played back from a computer. Proficiency in traditional musical instruments is no longer a prerequisite for creative musical expression.

Virtual reality allows us to imagine new paradigms for musical performance and creativity, by allowing people to collaborate remotely in real-time. Feelings of co-presence (the sense that a collaborator is experiencing the same set of perceptual stimuli at the same time) are essential for this creative process to occur, which virtual worlds are perfect for delivering. However, musical collaboration in a virtual world has historically been difficult to achieve because of the need for collaborators to play their music to a common beat, something that would require near zero latency across the data network. What is needed is a system of combining musical decisions across a network that syncs all decisions to the same beat without sacrificing the user's sense of immediacy.

SUMMARY OF THE INVENTION

The present invention enables clients (users or other users) to collaboratively mix musical samples and computer-generated sounds in real-time in a three-dimensional virtual space. Each user is able to independently make musical choices and hear other users' musical choices. For each user, the volume and direction of music coming from another user or other sound-emitting entity, is dependent on how far away that entity is in the virtual space, as well as the angle required to turn and face the entity. Further, if a user moves towards another user in the virtual space, their music becomes louder to the other user and vice versa. Correspondingly, if the original, local user remains stationary facing one direction and a second, remote user who is playing music moves from left to right across the local user's field-of-view, the music emanating from the remote user will pan from left to right in the local user's unique musical mix ('Mix').

The invention overcomes problems of latency between users by loading all musical samples ('Samples') to the user before collaboration begins. Every Client has a graphical interface through which they listen to a library of musical Samples ('Library') and select individual Samples to play inside the musical-mixer ('Mixer'). In the Mixer a user can adjust parameters for individual Samples such as raise or lower the volume of a Sample ('Volume'), or enable effects that distort the sound of individual samples ('Effects'). This information is then combined by the client application with the information pertaining to the musical choices of all other users in the virtual space in such a way that the volume and direction of sounds played by other users reflects their relative position in virtual space. All repeating Samples ('Loops') are synced by the server and/or client application so that they begin at the same time for that local user.

All data pertaining to the musical choices of users in virtual space is given a time value ('Time-Stamped') then recorded to a data file ('Data File') that can be retrieved at a later time to play again within the game ('Playback') or used to produce a digital audio file (such as an MP3 or other digital format) that can be played outside of the game.

In one embodiment of the invention users are able to listen to a musical performance ('Concert') with other users and contribute to the music using their own Graphical Interface without being heard by other users. This unique musical Mix can be recorded so that the user can Playback the Mix at a later time and/or produce an audio recording of the Mix including their own contribution to the performance.

The system provides each user with a client application for combining the musical decisions of all users into a unique musical mix. The system includes a local client and a remote client. The system includes a system server operatively connected to each client application to receive position data and audio data from the local client and the remote client. A graphical interface is provided to each user, by which that user can make musical decisions. The client application generates a unique musical mix based on position data and audio data for each user.

BRIEF DESCRIPTION OF THE DRAWINGS

The invention description below refers to the accompanying drawings, of which.

DETAILED DESCRIPTION

A system is described that combines virtual world interaction with creative musical expression to enable collaborative music-making in virtual space in the absence of a low-latency data connection and requiring no previous musical background or knowledge. The system draws data from a "virtual world", which as used herein refers to an online, computer-generated environment for a user to guide his or her 'Avatar', or digital representation of their physical selves to accomplish various goals. The user, through a client application, accesses a computer-simulated world that presents perceptual stimuli to the user. The user can manipulate elements of the modeled world and thus experience 'Telepresence', the sense that a person is present, or has an effect at a location other than their true location. The virtual world can simulate rules based on the real world or a fantasy world. Example rules are gravity, topography, locomotion, real-time actions, and communication. Communication between users ranges from text, graphical icons, visual gesture, sound, and additionally, forms using touch, voice command, and balance senses. Typical virtual world activities include meeting and socializing with other avatars (graphical representation of a user), buying and selling virtual items, playing games, and creating and decorating virtual homes and properties.

Relative Distance

Figure 1A:
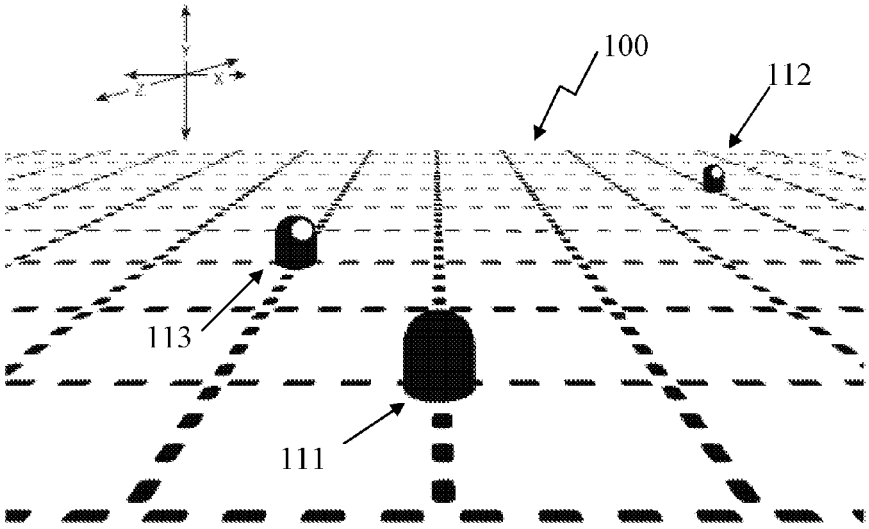
FIG. 1A is a front perspective view of a flat virtual space having a plurality of users according to an illustrative embodiment.
Figure 1B:
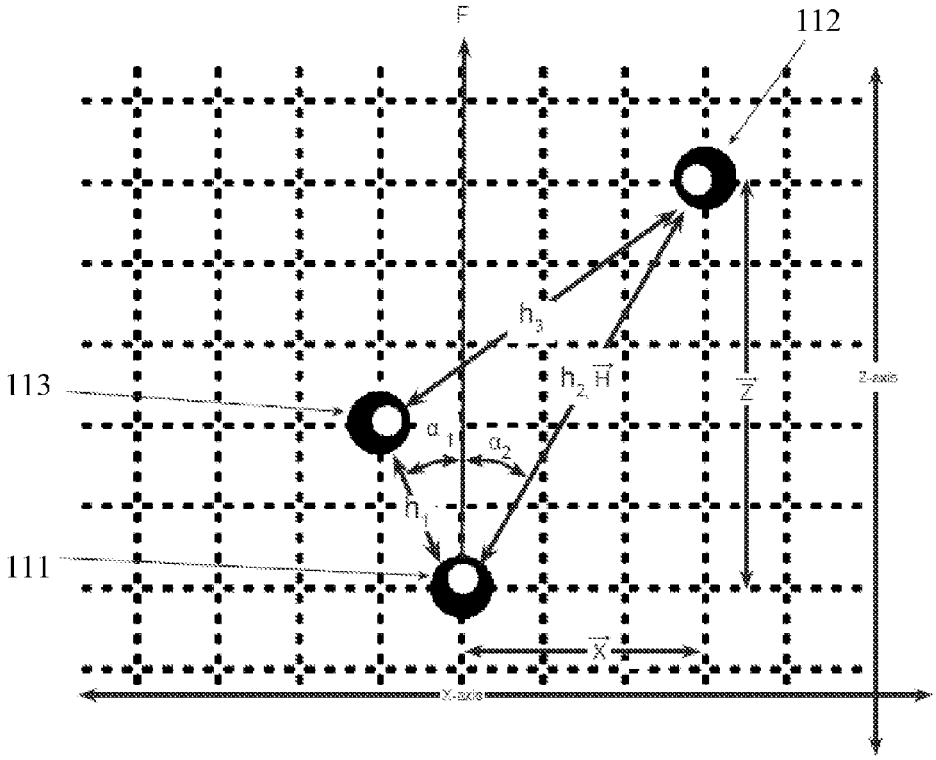
FIG. 1B is a top perspective view of a flat virtual space having the plurality of users according to the illustrative embodiment.

FIGS. 1A and 1B illustrate how relative distance and direction is calculated from X, Y and Z coordinates in virtual space. FIG. 1A is a front perspective view of a virtual space 100, and FIG. 1B shows the corresponding top perspective view. In this virtual space 100 each user is able to independently navigate along the X, Y and Z axes. At any time the location of a user can be represented by integer values along these three axes ('Coordinates'). Relative distance is defined as the shortest distance between two points, and can be calculated according to one of a number of different procedures. Referring to the top view of FIG. 1B, the shortest distance between ClientOne 111 and ClientTwo 112 is labeled $h_2$, and can be calculated, for example, using the Pythagorean theorem to find the length of the hypotenuse of a triangle made by the difference in X-Coordinates and the difference in Z-Coordinates of ClientOne 111 and ClientTwo 112. This distance can also be calculated using the law of cosines given the difference in X-Coordinates and the difference in Z-Coordinates of ClientOne 111 and ClientTwo 112, as well as the angle between them.

While in FIGS. 1A and 1B all clients are positioned at the same Y-Axis value, the system allows for variable positioning in all three axes. The relative distance between ClientOne 111 and ClientThree 113 is $h_1$. The relative distance between ClientOne 111 and ClientTwo 112 is $h_2$. This information is used to calculate the volume of music ClientOne 111 hears, as described in greater detail herein below. If ClientThree 113 is playing Sample A at volume X, and ClientTwo 112 is playing Sample B at the same volume, ClientOne 111 will hear Sample A at a louder volume than Sample B because the Volume of a Sample is inversely proportional to the distance of the user playing that Sample.

Figure 1C:
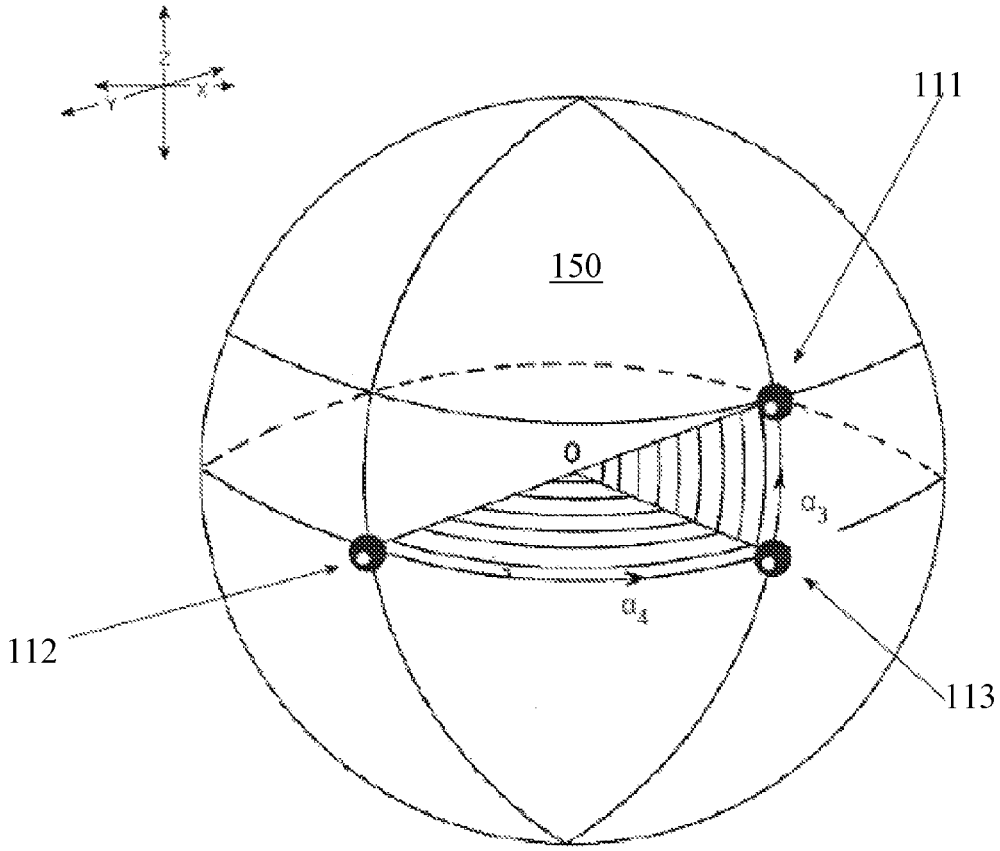
FIG. 1C is a front perspective view of a spherical virtual space having the plurality of users according to the illustrative embodiment.

FIG. 1C illustrates relative distance between users positioned on the surface of a sphere 150. While distance can still be defined as the shortest distance between users, distance can also be expressed in degrees (out of 360 degrees total). Here the distance between ClientOne 111 and ClientThree 113 is expressed as an angle $\alpha_3$ made by lines from each user to the centre of the sphere 150. The distance between ClientTwo 112 and ClientThree 113 is expressed as the angle $\alpha_4$. The volume of a sound emanating from a foreign (remote from the local) user is inversely proportional to the size of the angle created by lines connecting the local user to the center of the sphere 150 and the foreign user to the center of the sphere 150.

Relative Angle

Stereophonic sound ('Stereo') refers to the distribution ('Pan') of sound using two or more independent audio channels so as to create the impression of sound heard from various directions, as in natural hearing. For this explanation we limit the number of audio channels to two (Left and Right), however the system is capable of distributing sound over a limitless number of channels.

In one embodiment of panning in a stereo mix, the sound appears in only one channel (Left or Right alone). If the Pan is then centered, the sound is decreased in the louder channel, and the other channel is brought up to the same level, so that the overall 'Sound Power Level' is kept constant. In FIG. 1B ClientOne 111 is shown facing point 'F'. The angle that ClientOne 111 must rotate to face ClientThree 113 is $\alpha_1$. The angle that ClientOne 111 must rotate to face ClientTwo 112 is $\alpha_2$. These angles can be calculated in a number of ways, for example, using trigonometry on the triangle connecting the two users via the X and Z-axis, and then comparing this value to the 'Rotation Angle' of the User (the direction the User is facing relative to the Z or X-axis). This information is used to calculate the Pan of each sound. If ClientThree 113 is playing Sample-A, and ClientTwo 112 is playing Sample-B, ClientOne 111 will hear Sample-A mainly in the Left of the Stereo Mix, and Sample-B mainly on the Right of the Stereo Mix. In FIGS. 1A and 1B, because LocalUser (ClientOne) is facing in the same direction as the Z-axis, there is no adjustment for the rotation of LocalUser. If LocalUser is then rotated to face ClientThree 113, the direction of ClientTwo 112 from LocalUser would be the sum of angles $\alpha_1$ and $\alpha_2$.

TECHNICAL TERMS

Sample-based Music: Sample-based music is music that is produced by combining short musical recordings or Samples in a modular fashion to create a single continuous composition.

Samples: A musical sample is a sound of short duration, such as a musical tone or a drumbeat, digitally stored for playback. Once recorded, samples can be edited, played back, or looped (played repeatedly). For the purpose of this document we are dividing Samples into two subsets; Loops and Hits.

Loops: In music, a Loop is a Sample or Computer Generated Sound that is repeated. These are usually short sections of tracks (often between one and four bars in length), which have been edited to repeat seamlessly when the audio file is played end to end. Use of prerecorded Loops has made its way into many styles of popular music, including hip hop, trip hop, techno, drum and bass, and contemporary dub, as well as into mood music on soundtracks. Today many musicians use digital hardware and software devices to create and modify loops, often in conjunction with various electronic musical effects. The musical Loop is also a common feature of video game music.

Single-Play Sounds (Hits): Single-Play Sounds or Hits are Samples or Computer Generated Sounds that play just once each time they are triggered. These can vary in length from a single note of an instrument like the beat of a drum, to a sound recording that extends the entire length of a song.

Graphical Interface Display

Figure 2A:
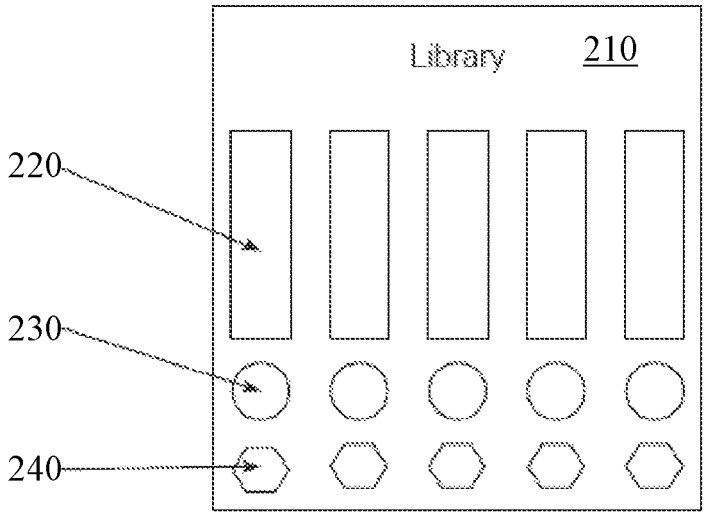
FIG. 2A is a simplified diagram of a user interface library that stores a plurality of musical parameters according to the illustrative embodiment.
Figure 2B:
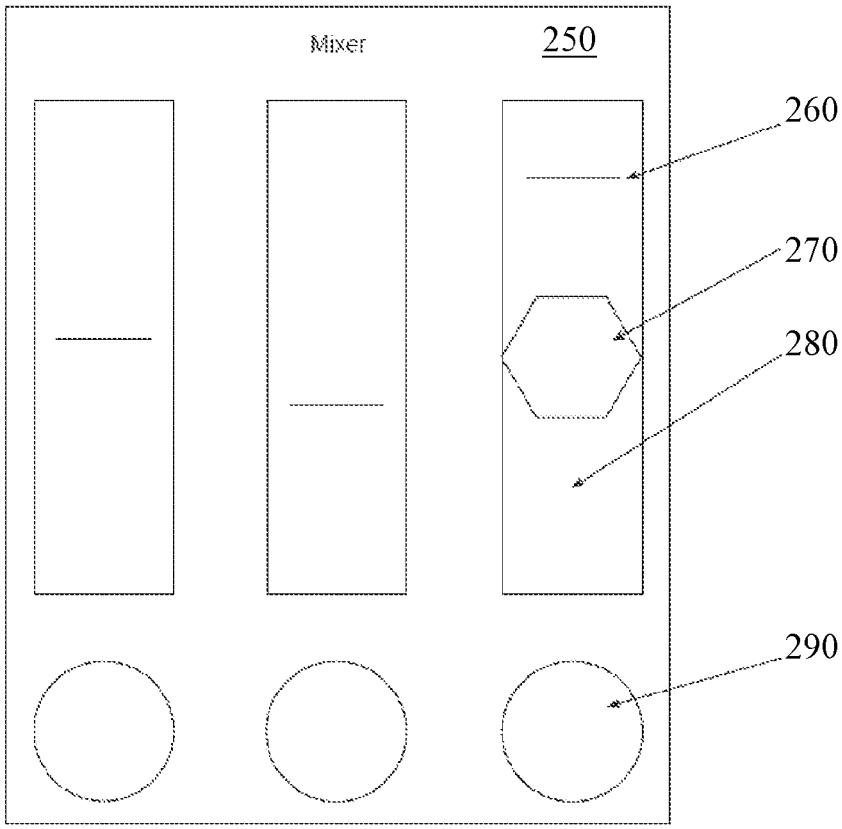
FIG. 2B is a simplified diagram of a user interface mixer that allows for musical collaboration according to the illustrative embodiment.

FIGS. 2A and 2B illustrate a simplified diagram of a user interface library and mixer, respectively, for a graphical interface for users to contribute to a live musical Mix by selecting and manipulating Loops and Hits. The graphical interface can be handled by various client computers, system servers, client applications running on a client computer or a system server, or any combination thereof, as readily apparent to those having ordinary skill.

As shown in FIG. 2A, a library 210 includes a selection of Loops 220, Hits 230 and Effects 240. A user can listen to or otherwise review individual Loops 220, Hits 230 or Effects 240 by interacting with their respective graphical representations. Based on this information a user can choose to add a Loop 220, Hit 230 and/or Effect 240 to his or her Mixer 250.

Shown in FIG. 2B, the mixer 250 allows a user to manipulate, modify or change the audio parameters for Loops 280 or Hits 290. For example a user could choose to raise or lower the volume of a Loop 280 by interacting with Volume Slider 260. An Effect 270 can be placed on Loop 280 to distort or otherwise modify the sound of that individual Sample. This information is then combined with parameters of musical selections of all other clients in the Virtual space to create a live Mix by the server and/or client application.

Figure 2C:
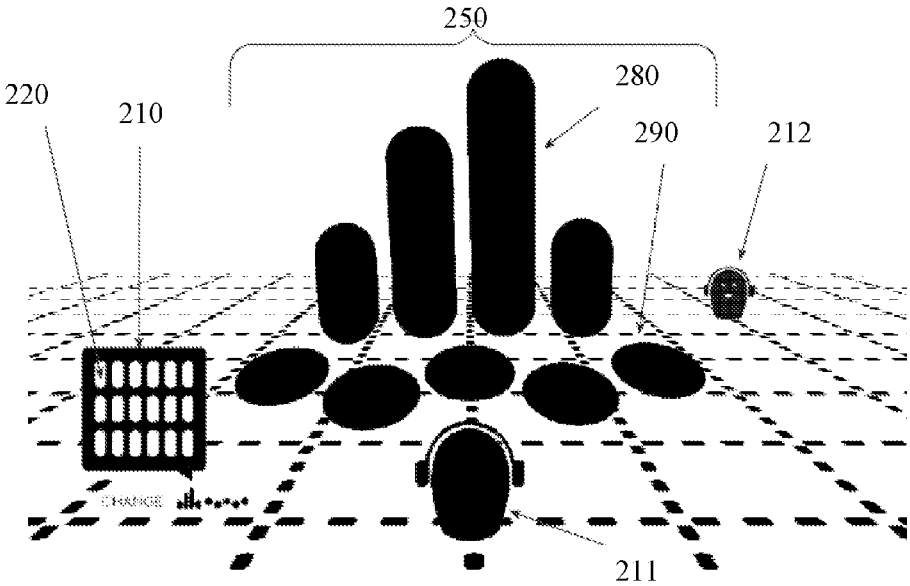
FIG. 2C is an exemplary screen having various functions for musical collaboration according to the illustrative embodiment.
Figure 2D:
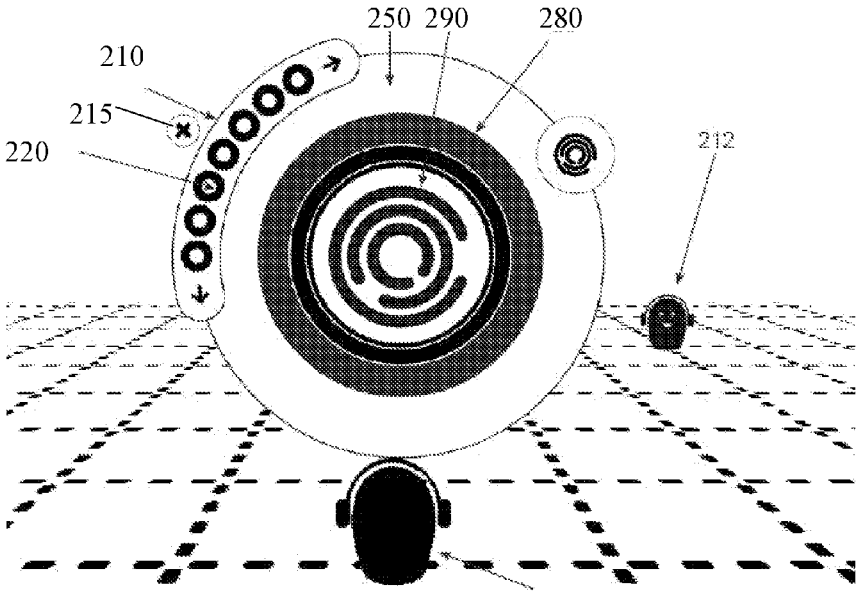
FIG. 2D is an exemplary screen with the same functions for musical collaboration as of FIG. 2C but of different design according to the illustrative embodiment.

FIGS. 2C and 2D respectively show actual examples of a Mixer 250 and Library 210 of the system positioned in a virtual space showing a LocalUser 211 and a remote user, hereinafter ClientTwo 212, collaboratively making music together. In both examples the LocalUser 211 has opened the Loop Library 210, and is able to exchange Loops 220 from the Library 210 with Loops 280 in the Mixer 250 as well as manipulate audio parameters for Loops 280 and/or Hits 290 in the Mixer 250.

Musical Collaboration System

Figure 3:
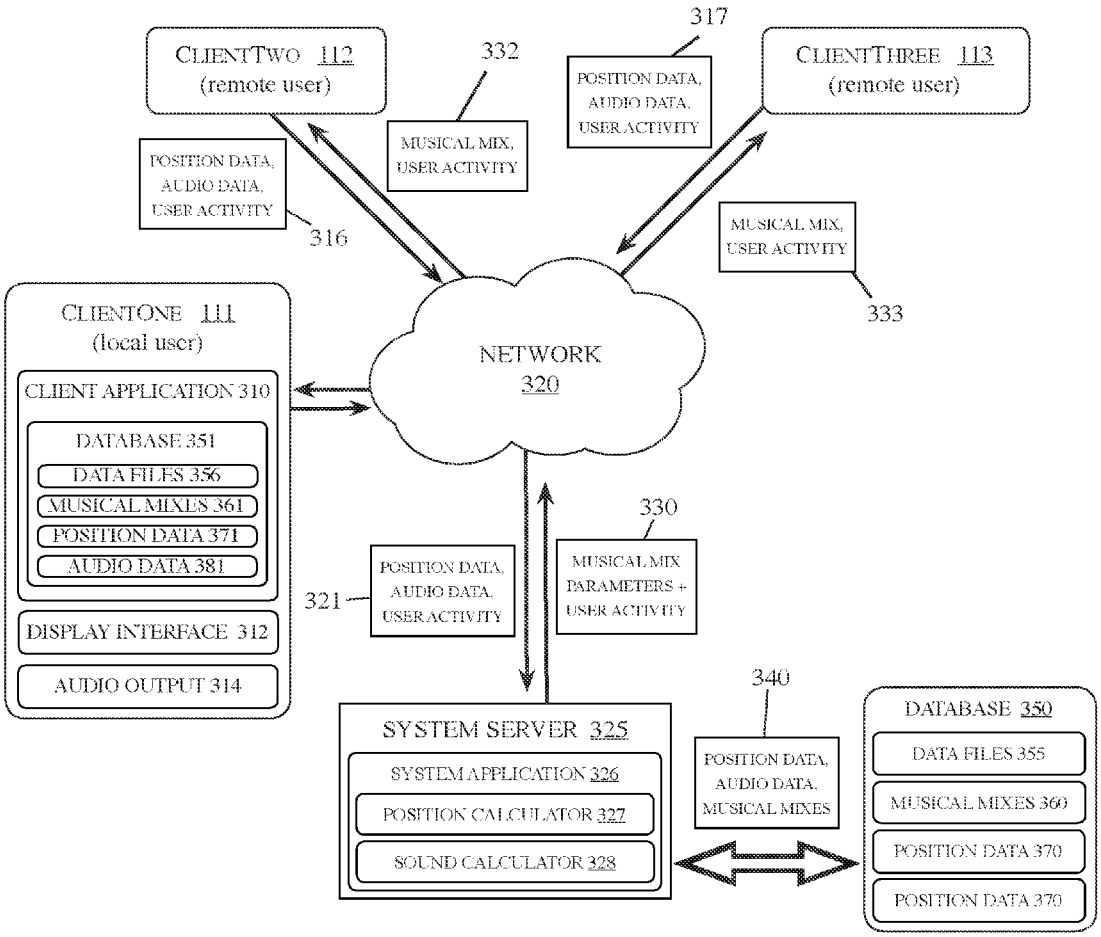
FIG. 3 is an overview block diagram of a musical collaboration system including a plurality of users and a system server, according to the illustrative embodiment.

FIG. 3 is a schematic block diagram of a musical collaboration system 300 for creating a live musical mix. In the system 300, data from the system server 325 pertaining to the location and musical decisions of all other users in the virtual space is gathered. This data is then combined with musical decisions of the local user to create a live musical Mix relative to the position of all sound-emitting entities in the virtual space. The system server can comprise one or more computers, can be a single computer, or a combination of computers and computing devices.

All users 111, 112, and 113, respectively transmit, via datastreams 315, 316, and 317, X, Y & Z-axis Coordinates along with data pertaining to which samples are being played at what volume and with which effects to the system server 325 via datastream 321. Server then in turn sends each Client data pertaining to the position and musical arrangement of all other Users as these parameters change via datastream 330. This data is respectively sent to each user 111, 112 and 113 via datastreams 331, 332 and 333. This information is used by either a system application 326 residing on the server (with a position calculator 327 and sound calculator 328), or a client application 310 local to the user (with a position calculator 311 and sound calculator 312), to create a live musical Mix. The local user 111 also includes a display interface 313 for displaying the virtual space, as well as audio output 314 for playing the audio corresponding to the display.

The division of tasks between the system server application 326 and the client application 310 are highly variable. The tasks have been described as occurring by a particular application for illustrative and descriptive purposes, however either application can perform the various tasks of the system. Additionally, third party applications can interface via the network for billing, social networking, sales of items (both real and virtual items), interface downloads, marketing or advertising.

The client application uses a generic 3D engine to visually display other users in virtual space. In an exemplary embodiment of the system the Papervision 3D-Engine is used to position users in virtual space, and Flash is used for the musical Sampler. The Sampler has access to all Sounds that can be emitted by users in virtual space. The client application syncs all Loops so that the Loops begin and end playing in a synchronized manner regardless of which Entity is emitting that Loop.

The client application can either play Hits immediately or create a list of Hits to be played on the next available fraction of a beat. By waiting for the next available fraction of a beat the client application ensures all Samples are played in a rhythmical manner.

The resulting musical mix of combining musical selections of other users relative to their distance and direction from a local user in virtual space is sent to the local user's audio output 314 based upon both library and mixer inputs.

All actions within Mixer are combined with data pertaining to the musical selections of all other Users and their distance and direction from LocalUser in the virtual space, and the resulting list of data is recorded by either the system server via datastream 340 into a database 350 as data files 355, or by client application 310 into database 351 as data files 356. Data files 355 and 356 can be retrieved at a later time for Playback or used to produce a Digital Audio File. The database 350 also includes the musical mixes 360 generated by the system application, as well as position data 370 and audio data 380. The database 351 includes musical mixes 361 generated by the client application, as well as position data 371 and audio data 381. The volume of each Sample is calculated by adding together the contributions to that Sample by all Users in the Virtual space ('Sound Calculation'), as described in greater detail below.

Sound Calculation Parameters

Parameters of sound calculation include:

- The Relative Distance of all sound-emitting users from LocalUser
- The Relative Direction of all sound-emitting entities with respect to LocalUser (applicable to multi-channel Mix)
- The parameters of Audio emanating from each sound-emitting entity.

Position Calculation

Relative Distance and Relative Direction can be calculated separately from the overall Sound Calculation and then referenced when required, or calculated as a part of the Sound Calculation itself. Some generic 3D engines (e.g. Unity Engine) calculate these values as part of their basic functions. These can therefore be accessed by the client application when required. In an illustrative embodiment these values are calculated independently of the Sound Calculation, in a set of calculations known as the 'Position Calculation'.

Figure 4:
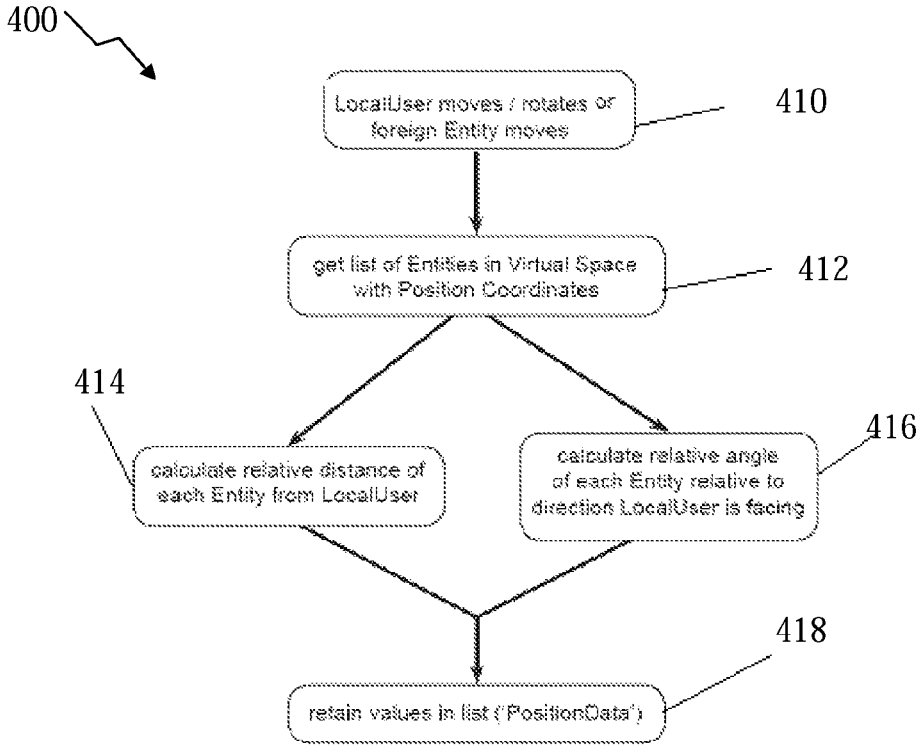
FIG. 4 is a flow diagram detailing a position calculation procedure to update the distance and direction of users in a virtual space, according to the illustrative embodiment.

FIG. 4 illustrates the steps involved in an exemplary process when the Direction and/or Distance of each user is calculated independently of the Sound Calculation. According to an example of the illustrative embodiment, Relative Distance and Relative Direction of each foreign (remote) user are determined by a position procedure 400 when a user moves or rotates at step 410. This can be, for example, the local user moving or rotating, or a "foreign" (i.e. spatially displaced, or remote) user is moving with respect to the local user. The server application obtains a list of clients in the virtual space, with the corresponding position coordinates, at step 412. The position application calculates the relative distance of each entity from the local user at step 414, as well as the relative angle of each entity relative to the direction the local user is facing at step 416. The server then stores these values at step 418 into the database (e.g. database 350 and/or 351 of FIG. 3).

These values are stored in the system database, to be referenced by the Sound Calculation procedure as necessary. Note that the relative distance calculation is required for the mono-channel mix, while the stereo mix needs the relative direction of the foreign entities as well. For the purpose of calculating relative distance and direction, LocalUser can be defined as the local user's avatar, or the camera that is filming the virtual space associated with that avatar, or a combination of the two (for example the position of the avatar and direction of the camera). Notably, as used herein the term LocalUser refers to the position of the local user avatar and direction that the avatar is facing.

Example 1

Position Calculation

Referring back to FIGS. 1A and 1B, assume that the local user is ClientOne 111 for this exemplary calculation and that ClientTwo 112 has just moved into the position shown. The change of position for ClientTwo 112 triggers the Position Calculation for the local user 111 to establish the new Distance and Direction for ClientTwo 112. For explanatory purposes the distance and direction are calculated independently. Distance $h_2$ can be calculated, for example, using the Pythagorean theorem to find the length of the hypotenuse of a triangle made by the difference in X-Coordinates and the difference in Z-Coordinates;

$$h_2^2=(X_{12}\sim X_{14})^2+(Z_{12}\sim Z_{14})^2$$

$$h_2^2=3^2+5^2$$

$$h_2=\sqrt{34}$$

$$h_2=5.83095$$

The direction of ClientTwo from the local user can be calculated according to a variety of procedures, for example using the inverse trigonometric functions. Arcsin can be used to calculate an angle from the length of the difference along the X-axis and the length of the hypotenuse.

$$\alpha_2 = \arcsin\left(\frac{X_{12} - X_{14}}{h_2}\right)$$

Arccos can be used to calculate an angle from the length of the difference along the Z-axis and the length of the hypotenuse.

$$\alpha_2 = \arccos\left(\frac{Z_{12} - Z_{14}}{h_2}\right)$$

Arctan can be used to calculate an angle from the length of the difference along the X-axis and the length of the difference along the Z-axis.

$$\alpha_2 = \arctan\left(\frac{X_{12} - X_{14}}{Z_{12} - Z_{14}}\right)$$

Because the local user is facing in the same direction as the Z-axis in FIGS. 1*a* and 1*b* there is no adjustment for the rotation of the local user.

The current system uses the law of cosine to calculate the relative offset position vector of the other users from the local user. The offset vector contains both relative direction, and distance. The law of cosines is equivalent to the formula;

$$\vec{X}\cdot\vec{Z}=\|\vec{X}\|\|\vec{Z}\|\cos\alpha_2$$

which expresses the dot product of two vectors in terms of their respective lengths and the angle they enclose. Returning to FIG. 1B the vector $\vec{x}$ expresses the difference between X-coordinate of the local user 111 and the X-coordinate of ClientTwo 112 along with the direction of the X-axis. Similarly the vector $\vec{Z}$ expresses the difference between Z-coordinate of the local user 111 and the Z-coordinate of ClientTwo 112 along with the direction of the Z-axis. The dot product of these two vectors is equivalent to the length of the hypotenuse of a triangle formed by these two lines, along with the direction of the resulting hypotenuse. A version of the law of cosines also holds in non-Euclidean geometry, like the spherical geometry of FIG. 1C. These values for Distance (h) and Direction (α) are retained as PositionData for the subsequent Sound Calculation, and are stored in a system database and/or client application database.

Sound Calculation

Figure 5:
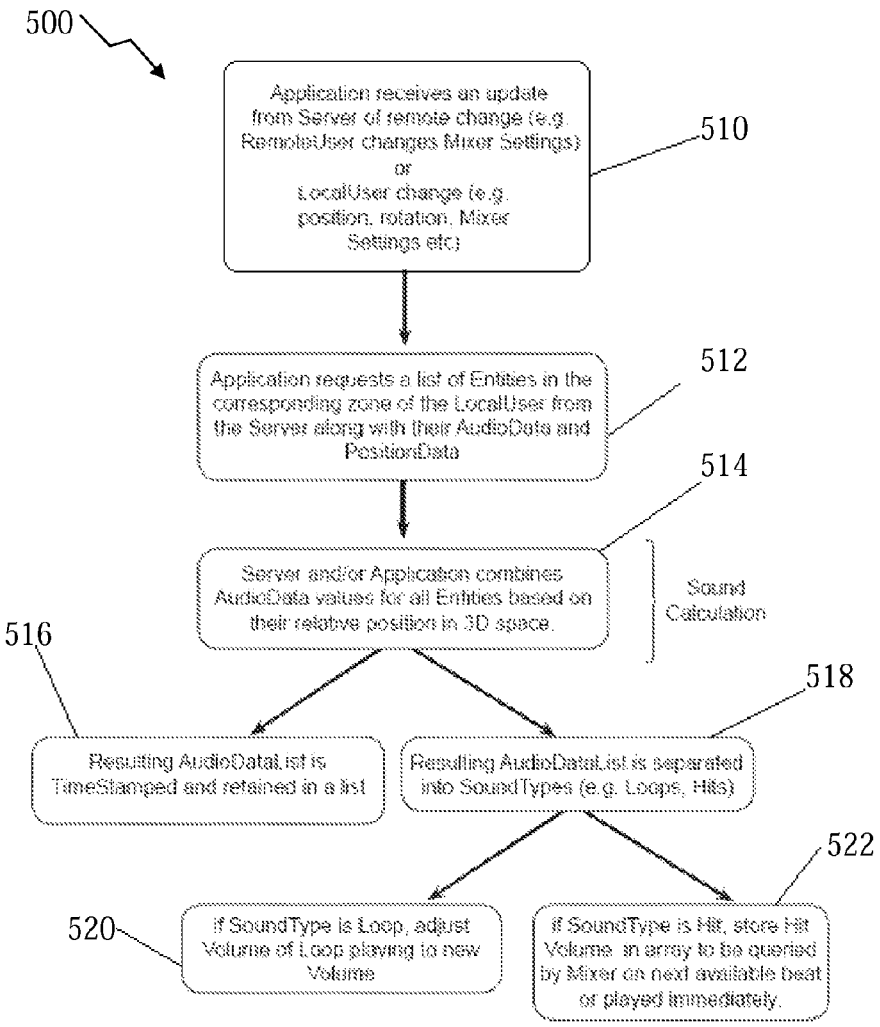
FIG. 5 is a flow diagram detailing a sound calculation procedure to adjust volume for a local user, according to the illustrative embodiment.

FIG. 5 is a flow diagram for a Sound Calculation procedure 500 that combines the Distance and Direction of all Users from LocalUser (PositionData) with the audio parameters of those same Users (AudioData) to create a unique musical Mix which is used by the client application to trigger new Sounds in the live Mix as well as update the Volume of all Loops in the Mix. The same Calculation can also be retained for Playback at a later time within the client application or used to create a Digital Audio File that can be listened to outside of the Application. In an illustrative embodiment, this Sound Calculation is triggered by either an update from the Server of a remote change (e.g. a remote user changes the configuration of their Mixer), or when the LocalUser makes a change to their position, rotation or Mixer settings at step 510 of the procedure 500. It is contemplated that this calculation can be triggered by a host of events, including but not limited to predetermined temporal intervals, and what is important is that the calculation occurs frequently enough to maintain the suspension of disbelief that music originating from foreign entities that are originating from the same position in virtual space as the visual representation of that sound-emitting entity.

In an illustrative embodiment, a client application sends a request to the Server for a list of users in the corresponding virtual space, along with their 'AudioData' and 'PositionData' at step 512. AudioData refers to the parameters of sound emanating from a user before position is taken into account. PositionData refers to the direction and/or distance of the remote user from the local user. In another embodiment of the system the PositionData is calculated as part of the Sound Calculation using the Coordinates of each user to calculate Distance and Direction, as discussed herein. A user may be a foreign user (in which case the AudioData refers to the state of the Client's Mixer), or it may be a computer generated Entity such as a Plant or an Animal.

The Server obtains a list of all users, including his or her AudioData and PositionData, to be used for the Sound Calculation at step 514. The client application then combines AudioData for Samples with matching SoundIDs to give the 'GlobalAudioData' at step 514. SoundIDs are the names given to each unique Sample or Computer Generated Sound that can be accessed by the client application. The resulting GlobalAudioData is then recorded with the time of the Calculation ('TimeStamp') and retained at step 516 for Playback and/or the creation of a Digital Audio File. With each cycle GlobalAudioData is separated by SoundType at step 518 and used to update the Volume of each Sample playing in each Channel as well as triggering Hits.

In an alternate embodiment of the system, the Sound Calculation can be split between the server application and the client application. The server application combines AudioData for all matching SoundIDs (Sample_A, Sample_B, Sample_C, etc.) in the virtual space apart from those emanating from the local user to give an 'External' Volume for each Sound. This new list of ExternalAudioData contains a single Volume value for every unique SoundID, which is then passed to the client application to be combined with the Volume values of sounds being played by LocalUser to give the Global Volume for each Sound.

The resulting list of AudioData is then separated by SoundType (i.e. Loop, Hit or Computer Generated Sound). Volumes for all Loops being played by the Application are adjusted to match the latest AudioData list at step 520. Hits are either triggered immediately or placed into a queue by the Application to be triggered on the next available fraction of a beat at the Volume and Pan as calculated by Sound Calculation at step 522.

Example 2

Sound Calculation (Mono Mix Calculated Entirely by Application)

Figure 6:
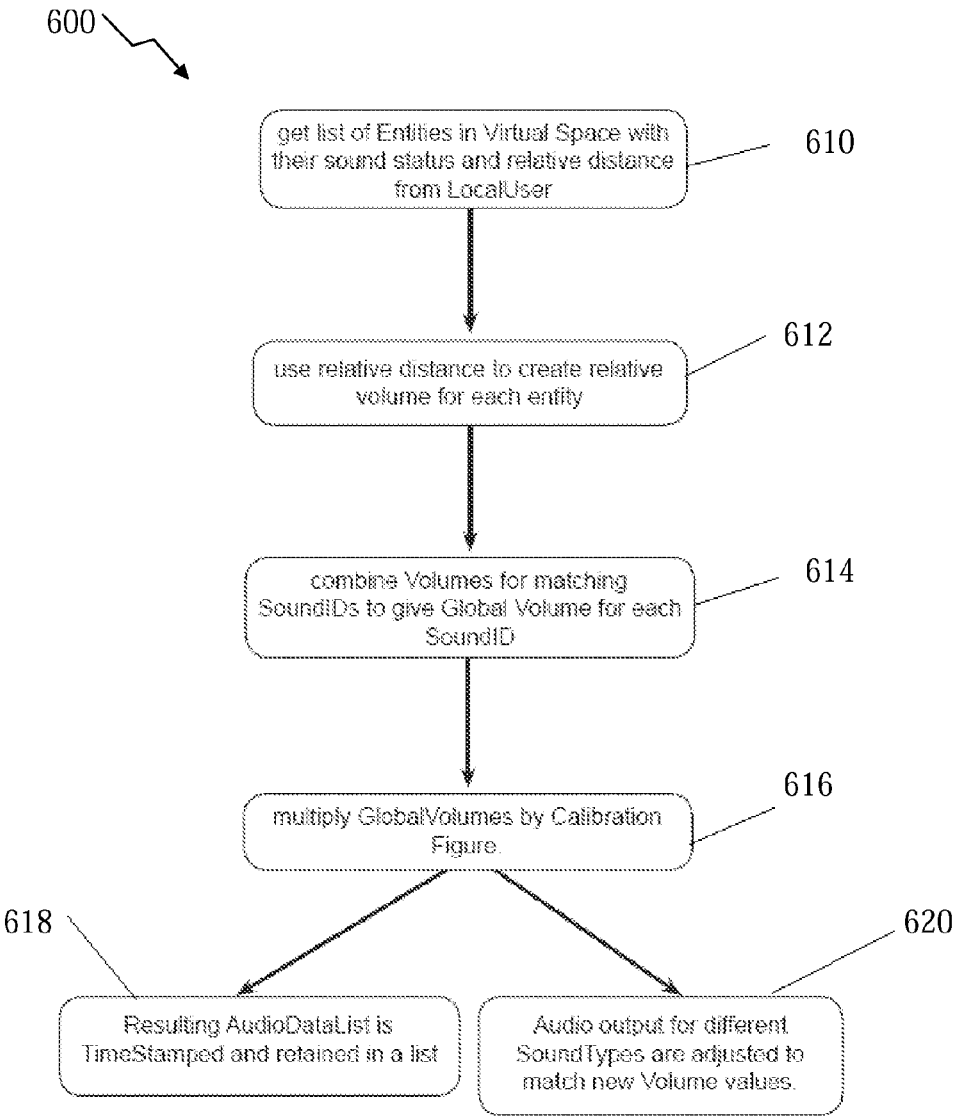
FIG. 6 is a flow diagram detailing a sound calculation procedure for a single-channel mix, according to the illustrative embodiment.

FIG. 6 shows a procedure 600 for a Sound Calculation handled entirely by the client application for a single Channel (Mono) Mix. It is expressly contemplated that these functions and steps can be carried out, in whole or in part, by a system server. Returning to FIGS. 1A and 1B as an example, ClientOne 111 (local user) is playing Sample A at full volume and is stationary at Position shown. ClientTwo 112 has just moved into the Position shown and is playing Sample A and Sample B at full volume. ClientThree is stationary at the Position shown and is playing Sample C at full volume. The Sound Calculation begins by assembling a list of all sound-emitting users in hearing range of the local user within the virtual space at step 610;

02/14/2009 14:31 hrs 21 s 62 ms ClientTwo, h=5.83, SampleA=1.00 SampleB=1.00 SampleC=0.00

02/14/2009 14:31 hrs 21 s 62 ms ClientThree, h=2.24, SampleA=0.00 SampleB=0.00 SampleC=1.00

In this example '02/14/2009 14:31 hrs 21 s 62 ms' represents the TimeStamp by the Server, 'Client-2' represents the EntityID, 'h' represents the Distance of that Entity from LocalUser, 'Sample-A' represents the SoundID, and the value of the SoundID represents the Volume (between 0.0 and 1.0).

Volumes are then adjusted to account for the Distance of the Entity playing the Sound from the local user at step 612. Returning to FIG. 1B, the volumes of all Samples played by ClientTwo are multiplied the inverse of the length of the hypotenuse between ClientTwo and the local user. The resulting list of Audio values may look like the following;

02/14/2009 14:31 hrs 21 s 62 ms ClientTwo, SampleA=0.17 SampleB=0.17 SampleC=0.00

02/14/2009 14:31 hrs 21 s 62 ms ClientThree, SampleA=0.00 SampleB=0.00 SampleC=0.45

The Audio values of the local user can now be added to the overall list of Audio values;

02/14/2009 14:31 hrs 21 s 62 ms ClientTwo, SampleA=0.17 SampleB=0.17 SampleC=0.00

02/14/2009 14:31 hrs 21 s 62 ms ClientThree, SampleA=0.00 SampleB=0.00 SampleC=0.45

02/14/2009 14:31 hrs 21 s 62 ms ClientOne, SampleA=1.00 SampleB=0.00 SampleC=0.00

All matching SoundIDs are then combined at step 614 to give Global Volume values for every SoundID;

02/14/2009 14:31 hrs 21 s 62 ms SampleA=1.17 SampleB=0.17 SampleC=0.45

All volume values are multiplied by an overall calibration figure at step 616 that serves to reduce the Volume of each user so that no one user can achieve 100% Volume on its own regardless of its distance from the local user. This can occur at any step during the procedure, or not at all in certain embodiments. In the current version of the system the calibration figure is 0.8;

02/14/2009 14:31 hrs 21 s 62 ms SampleA=0.96 SampleB=0.16 SampleC=0.32

This set of Audio values is recorded in a list at step 618 for Playback, as well as used for adjusting the live musical Mix at step 620. To adjust the live musical Mix SoundIDs are separated by SoundType. If the SoundType is a Loop the Loop is already being played by the Application and only the Volume need be adjusted to match the new value. If the SoundType is a Hit that Hit can be played immediately at the calculated Volume in each Channel or stored in a list to be queried by the Application on the next available beat.

Example 3

Sound Calculation (Stereo Mix Calculated Entirely by Application)

Figure 7:
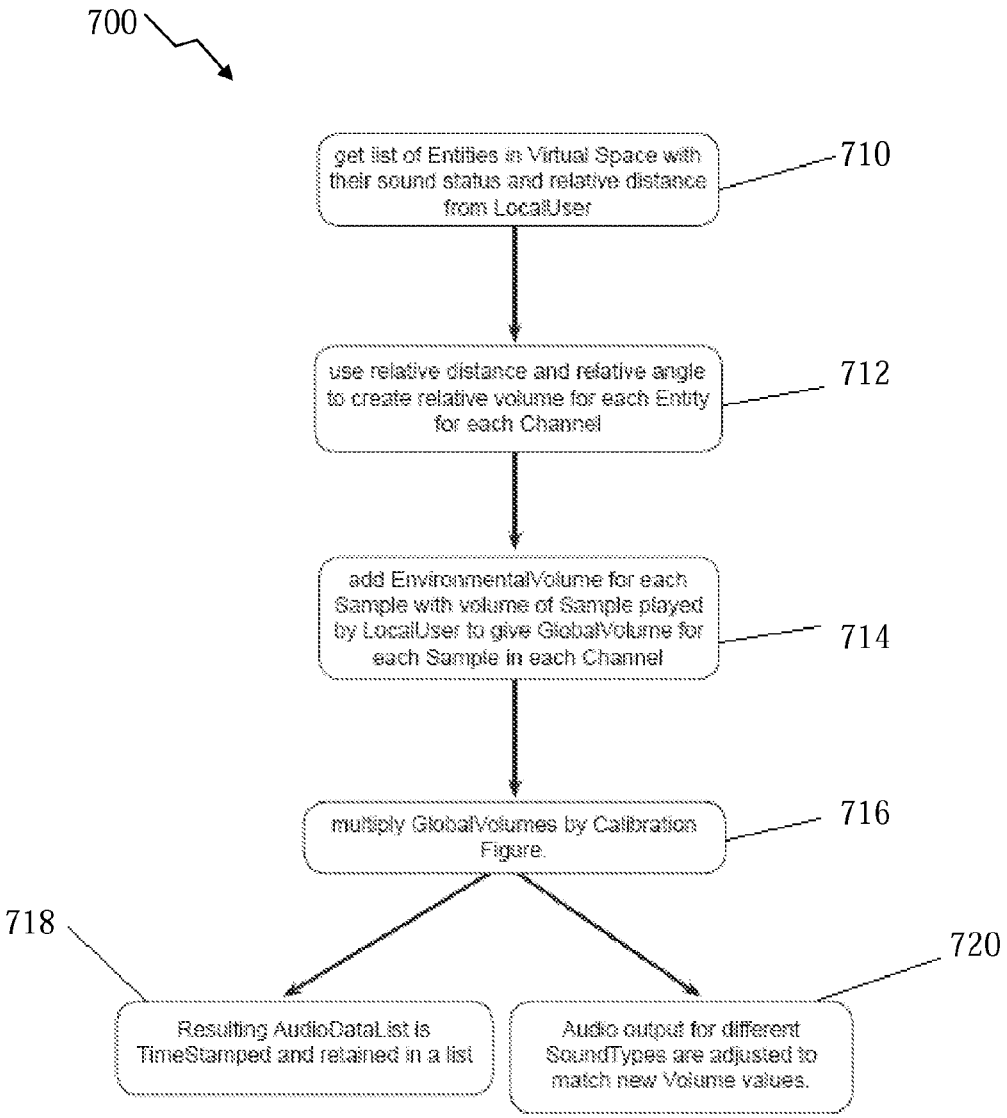
FIG. 7 is a flow diagram detailing a sound calculation procedure for a multi-channel mix, according to the illustrative embodiment.

FIG. 7 illustrates a process 700 that is similar to that of FIG. 6 but for a multi-channel Mix (Stereo). The Sound Calculation process 700 begins by assembling a list of all sound-emitting entities in hearing range of the LocalUser within the virtual space at step 710, but includes the relative Direction of each Entity from the Direction LocalUser is facing. The Volume of a single Sample emanating from a single Entity is calculated by combining the inverse length of the distance between the LocalUser and that Entity with the direction of the same Entity relative to the direction the LocalUser is facing as a fraction of the number of channels. This can be loosely expressed for a two channel Mix of Sample A emanating from ClientTwo 112 in FIG. 1B being heard by ClientOne 111 (the local user) facing direction F in the formulas;

$$V_L \propto \left(\frac{1}{h_2}\right) \times \left[0.5 + \left[\left(\frac{\alpha_2}{90}\right) \times 0.5\right]\right]$$

$$V_R \propto \left(\frac{1}{h_2}\right) \times \left[0.5 - \left[\left(\frac{\alpha_2}{90}\right) \times 0.5\right]\right]$$

where $V_L$ is the Volume of Sample A in the Left Channel and $V_R$ is the Volume of Sample A in the Right Channel of the local user 111.

If we take FIG. 1B as an example, the list can look like the following;

02/14/2009 14:31 hrs 21 s 62 ms ClientTwo, h=5.83, α=31.0
SampleA=1.00 SampleB=1.00 SampleC=0.00

02/14/2009 14:31 hrs 21 s 62 ms ClientThree, h=2.24, α=−26.5
SampleA=0.00 SampleB=0.00 SampleC=1.00

In this example '02/14/2009 14:31 hrs 21 s 62 ms' represents the TimeStamp by the Server, 'ClientTwo' represents the EntityID, 'h' represents the Distance of that user from LocalUser, 'α' represents the angle the local user would need to turn to face that user, 'SampleA' represents the SoundID, and the value of the SoundID represents the Volume at which the SoundID is being played (between 0.0 and 1.0).

Similarly to the procedure of FIG. 6, volumes are adjusted to account for the Distance of the Entity playing the Sound from the local user at step 712, but this time the resulting Volume is split across two channels depending on the relative Direction of that user. In this manner each user has two volume values for every SampleID. Returning to FIG. 1B, the volumes of all Samples played by ClientTwo are multiplied by the inverse of the length of the hypotenuse between ClientTwo and the local user. This resulting list is then divided across two channels depending on the size of the angle the local user is required to turn to face that remote user. The resulting list of Audio values may look like the following;

02/14/2009 14:31 hrs 21 s 62 ms ClientTwo, SampleAch1=0.06 SampleAch2=0.11 SampleBch1=0.06 SampleBch2=0.11 SampleCch1=0.00 SampleCch2=0.00

02/14/2009 14:31 hrs 21 s 62 ms ClientThree, SampleAch1=0.00 SampleAch2=0.00 SampleBch1=0.00 SampleBch2=0.00 SampleCch1=0.29 SampleCch2=0.16

'SampleAch1' refers to the contribution of specified EntityID to the Volume of SampleA in the Left Channel of the local user. 'SampleAch2' refers to the contribution of specified EntityID to the Volume of SampleA in the right Channel of the local user. The Audio values of the local user are now added to the overall list of Audio values;

02/14/2009 14:31 hrs 21 s 62 ms Client2, SampleAch1=0.06 SampleAch2=0.11 SampleBch1=0.06 SampleBch2=0.11 SampleCch1=0.00 SampleCch2=0.00

02/14/2009 14:31 hrs 21 s 62 ms Client3, SampleAch1=0.00 SampleAch2=0.00 SampleBch1=0.00 SampleBch2=0.00 SampleCch1=0.29 SampleCch2=0.16

02/14/2009 14:31 hrs 21 s 62 ms Client1, SampleAch1=0.50 SampleAch2=0.50 SampleBch1=0.00 SampleBch2=0.00 SampleCch1=0.00 SampleCch2=0.00

All matching SoundIDs are then combined for each Channel to give Global Volume values for every SoundID for every Channel at step 714;

02/14/2009 14:31 hrs 21 s 62 ms SampleAch1=0.56 SampleAch2=0.61 SampleBch1=0.06 SampleBch2=0.11 SampleCch1=0.29 SampleCch2=0.16

These values are then multiplied by an overall calibration figure at step 716 that reduces the volume of each user so that no single user achieves full volume on his or her own client application;

02/14/2009 14:31 hrs 21 s 62 ms SampleAch1=0.45 SampleAch2=0.49 SampleBch1=0.05 SampleBch2=0.09 SampleCch1=0.23 SampleCch2=0.13

Similar to the procedure of FIG. 6, the resulting set of AudioData is recorded at step 718 in a list for Playback or Digital Audio File production, as well as used for adjusting the live musical Mix at step 720. SoundIDs are separated by SoundType and used to update volumes and trigger sounds in the Mix.

Example 4

Sound Calculation (Stereo Mix Calculated Across Server and Application)

In an illustrative embodiment of the system the contributions of all users in the virtual space, including the original User, are calculated dynamically by each client application into a unique musical Mix. In another embodiment of the system the musical selections for each user are combined by server application to give 'External' Audio values for each unique SoundID, which are then sent to the client application to be combined with the contributions of the local user to give the Global Audio values for the same SoundIDs.

Figure 8:
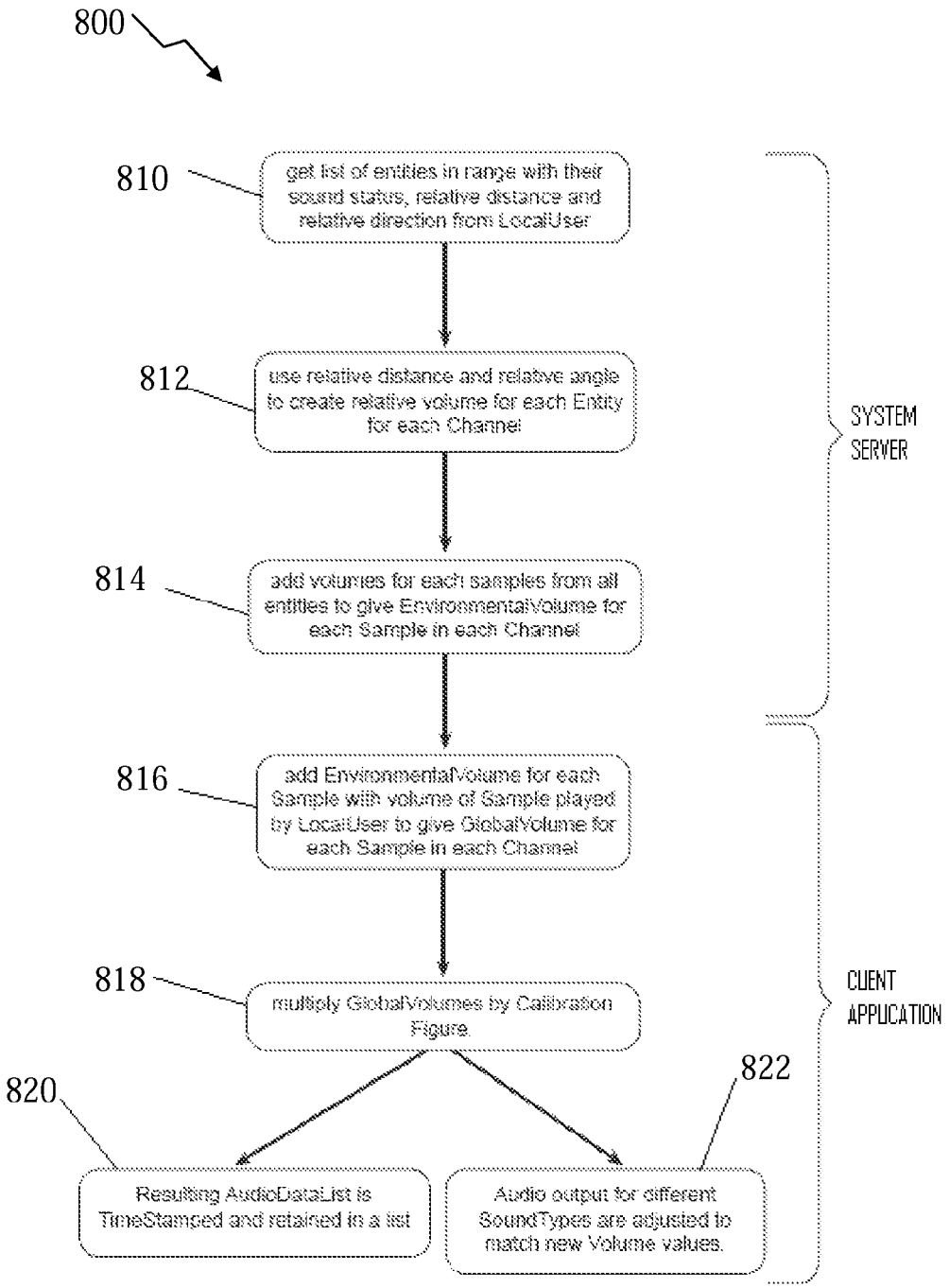
FIG. 8 is a flow diagram detailing a sound calculation procedure for a multi-channel mix, performed partially on the server and partially by the client application, according to the illustrative embodiment.

FIG. 8 illustrates the procedure 800 for sound calculation across the server application and the client application. Returning to the same scenario described in Example 2, the client Application requests an updated list of External Audio values following notification of a change in position of a sound-emitting entity. Server assembles a list of sound-emitting entities within range of LocalUser in Virtual space, including the relative Direction and Distance at step 810.

02/14/2009 14:31 hrs 21 s 62 ms ClientTwo, h=5.83, α=31.0 SampleA=1.00 SampleB=1.00 SampleC=0.00

02/14/2009 14:31 hrs 21 s 62 ms ClientThree, h=2.24, α=−26.5 SampleA=0.00 SampleB=0.00 SampleC=1.00

Volumes are then adjusted to account for the Distance of the Entity playing the Sound from the LocalUser across two channels depending on the relative Direction of that Entity.

02/14/2009 14:31 hrs 21 s 62 ms ClientTwo, SampleAch1=0.06 SampleAch2=0.11 SampleBch1=0.06 SampleBch2=0.11 SampleCch1=0.00 SampleCch2=0.00

02/14/2009 14:31 hrs 21 s 62 ms ClientThree, SampleAch1=0.00 SampleAch2=0.00 SampleBch1=0.00 SampleBch2=0.00 SampleCch1=0.29 SampleCch2=0.16

All matching SoundIDs are then combined for each Channel to give External Audio values for each unique SoundID for each Channel at step 814;

02/14/2009 14:31 hrs 21 s 62 ms SampleAch1=0.06 SampleAch2=0.11 SampleBch1=0.06 SampleBch2=0.11 SampleCch1=0.29 SampleCch2=0.16

This list is then passed from the server application to the client application where the Audio values of the local user are now added to the External Audio values at step 816;

02/14/2009 14:31 hrs 21 s 62 ms SampleAch1=0.06 SampleAch2=0.11 SampleBch1=0.06 SampleBch2=0.11 SampleCch1=0.29 SampleCch2=0.16

02/14/2009 14:31 hrs 21 s 62 ms Client1, SampleAch1=0.50 SampleAch2=0.50 SampleBch1=0.00 SampleBch2=0.00 SampleCch1=0.00 SampleCch2=0.00

Combining the External Audio values with the Audio values for LocalUser gives the Global Audio values.

02/14/2009 14:31 hrs 21 s 62 ms SampleAch1=0.56 SampleAch2=0.61 SampleBch1=0.06 SampleBch2=0.11 SampleCch1=0.29 SampleCch2=0.16

These values are then multiplied by an overall calibration figure at step 818 that reduces the volume of each user so that no single user can achieve full volume on his or her own. In the current version this calibration figure is 0.8;

02/14/2009 14:31 hrs 21 s 62 ms SampleAch1=0.45 SampleAch2=0.49 SampleBch1=0.05 SampleBch2=0.09 SampleCch1=0.23 SampleCch2=0.13

The resulting set of Audio values is recorded in a list at step 820 for Playback, as well as used for adjusting the live musical Mix. SoundIDs are separated by SoundType at step 822 and used to update Volumes and trigger sounds in the Mix.

A variety of single computer languages, or in combination, can be employed to implement the system described herein. Exemplary computer languages include, but are not limited to, C, C++, C#, Java, JavaScript, and Actionscript, among other computer languages readily applicable by one having ordinary skill.

Exemplary Operational Embodiment

Reference is now made to FIGS. 9-12, showing a plurality of exemplary screen displays for a graphical user interface implementing the client application, according to the illustrative embodiment. These screen shot displays are provided for illustrative and descriptive purposes only, to show an example of a possible configuration for implementing the teachings and descriptions herein.

Figure 9:
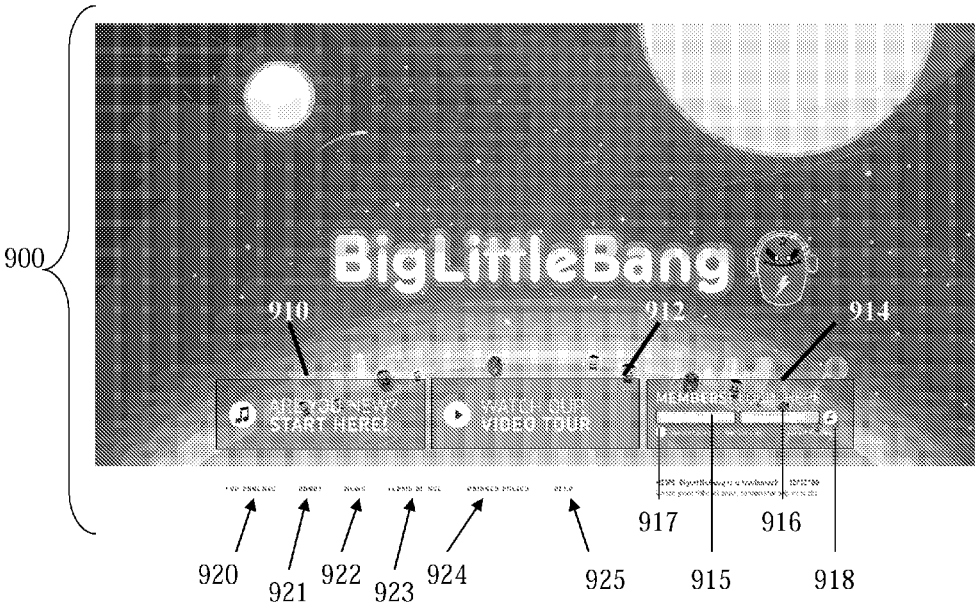
FIG. 9 is an exemplary screen display showing a home page for a graphical user interface of the musical collaboration system, according to the illustrative embodiment.

FIG. 9 is an exemplary screen display 900 for a home page of the musical collaboration system, through which a user navigates to create a client ID (identifier) for the musical collaboration system. As shown in FIG. 9, a new user can select the "ARE YOU NEW? START HERE!" box 910 to be navigated through the pages for creating a client on the musical collaboration system. A user is also presented with box 912 which allows the user to "WATCH OUR VIDEO TOUR", which is a video tour of the musical collaboration system and how it works. An already-existing user uses the box 914 to login to their client application, which includes a username entry box 915 and a password entry box 916.

According to an exemplary screen display, a user can select the box 917 which is to "Remember me on this computer", to remember the username on the computer. Also, if a user does not remember their password, there is a link provided to issue a new password—"Forgot Password?" 918.

The home page screen 900 also includes a series of links to other functions, not shown, but described herein. There is a "For Parents" link 920 that provides parents with information about the overall system, specifically for the parents of users of the system. In an illustrative embodiment, the system is designed to be used by a younger age group of people, but can be employed by any group interested in collaborative music-making. There is an "About" link 921, which provides visitors with information about the overall system. There is a "News" link 922 that navigates a user to a news page containing further related information. There is also a "Terms of Use" link 923 to provide users with the terms for using the overall system. The screen also includes a "Privacy Policy" link 924 that displays the system privacy policy, and finally a "Help" link 925, which provides users with resources for solving any problems they may have with the system.

Figure 10:
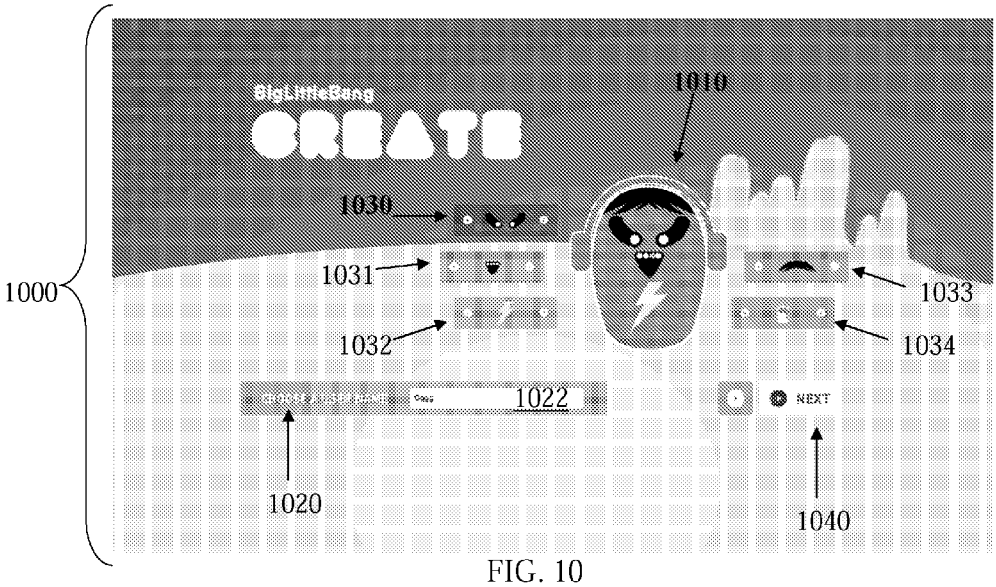
FIG. 10 is an exemplary screen display for a graphical user interface to create a user of the musical collaboration system, according to the illustrative embodiment.

A user desiring to create a new client for the overall system is directed to a screen such as exemplary create display screen 1000 of FIG. 10. As shown, a user creates their client "Avatar" 1010, or graphical representation of the user in virtual space. The client 1010 is assigned a name in box 1020 by typing a name into the region 1022. The user can select different eyes 1030, mouth 1031, flare 1032, hair 1033 and color 1034 to customize their client that will be visible on the client interface of the local user himself or herself, as well as to other users of the system. As shown, once a user is satisfied with their client representation 1010, they can select the "NEXT" button 1040 which directs them to the graphical interface display of FIG. 11 for collaborating a musical mix.

Figure 11:
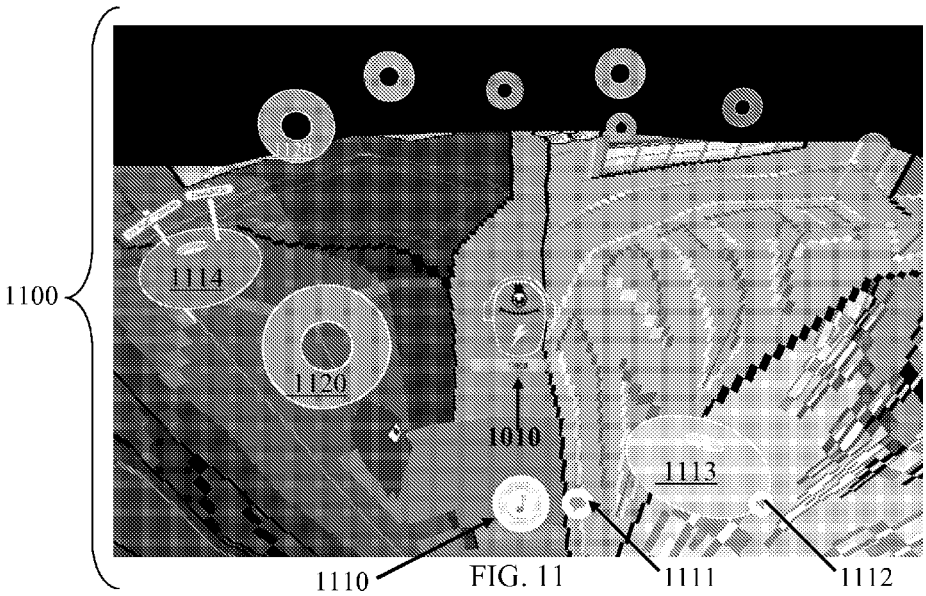
FIG. 11 is an exemplary screen display for a graphical user interface to navigate through virtual space and create a musical mix, according to the illustrative embodiment.

FIG. 11 shows an exemplary screen display 1100 for the graphical user interface generated by the client application and/or the server application working separately or together to create the visual output and audio output for the musical mix. As shown, the screen display 1100 includes the client representation 1010. The display shows a plurality of features for the graphical interface. Local user can access the musical mixer and musical libraries by pressing on button 1110 marked with a musical note. Pressing button 1110 opens the mixer 1250, which appears superimposed across the landscape as in FIG. 12. Returning to FIG. 11, local user can click button 1111 marked with a speech bubble to initiate a chat with other users of the site. Pressing button 1111 opens a chat window that local user may type into which when published appears in the virtual space and can be viewed by all users of the site. Button 1112 is a mute button, which when pressed will cease the audio output of the client application to the speakers of the local user. Items 1120 are musical loops that are positioned in virtual space. Local user may navigate into the musical loop, which will then unlock that particular loop within the library of loops for use within the mixer. In this way a user must find the sounds within the virtual space before he/she may use them in the musical mixer to create an original musical mix. Items 1113 and 1114 are examples of rocks or other objects in the landscape that users must navigate around.

Figure 12:
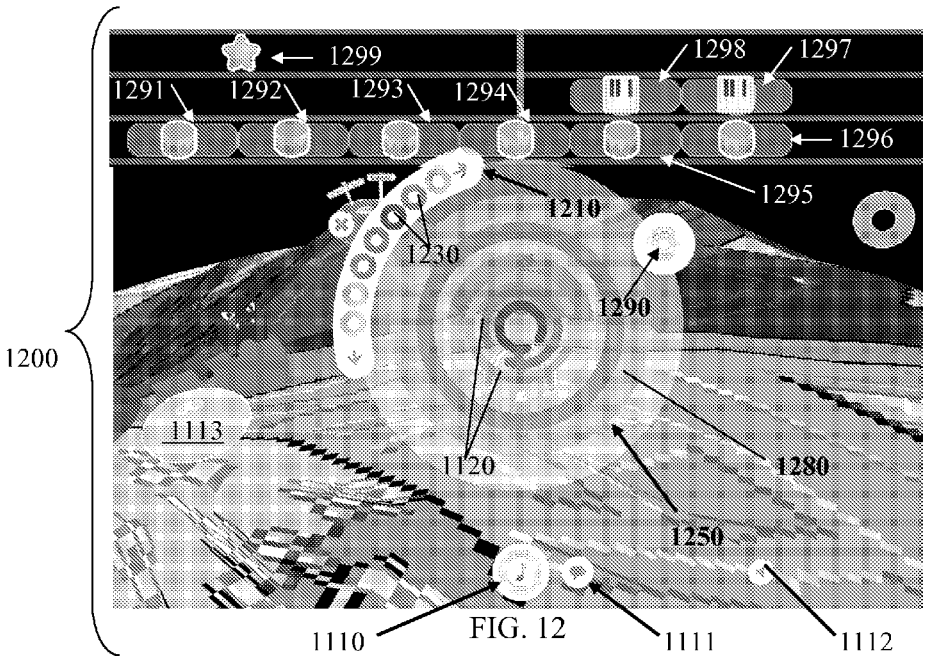
FIG. 12 is an exemplary screen display for a graphical user interface to navigate through virtual space showing user interface mixer and user interface library by which that user can make musical decisions, according to the illustrative embodiment.

As described hereinabove, the interface includes a plurality of hits 1230 and loops 1280 for collaborating and setting parameters for a musical mix. FIG. 12 shows an exemplary screen display 1200 for the graphical interface generated by the client and/or server application. As shown, there is provided a library 1210 that includes a plurality of loops 1220 that can be interchanged for the loops 1280 within the mixer 1250 to modify the musical mix. The button marked 1290 releases a library of Hits that can be interchanged for the hits 1230 within the mixer. According to the illustrative embodiment, the interface can also include icons 1291, 1292, 1293, 1294, 1295, 1296, 1297, 1298 and 1299, which are each a graphical representation of a datafile that approximates a musical notation so that the user can use the icon to repeat a performance of a song. A portion of each datafile corresponding to the icons 1291-1299 can also be added by using the mixer or an alternative graphical user interface. For example, icons 1291, 1292, 1293, 1294, 1295 and 1296 are each representative of a datafile for drums, or similar sounding musical loop. The drums are overlaid on a bar that represents the length of the loops for those instruments Note the icons 1297 and 1298 represent a piano or other appropriate sounding musical segment, and also include a bar representative of the duration of the loop. The star icon 1299 represents that it is a hit, and does not include a bar showing duration because it is a single sound.

It should be clear from the above description that the system and method provided herein affords a relatively straightforward, aesthetically pleasing and enjoyable interface and application for collaborating to create a musical mix in virtual space. The exemplary procedures and images are for illustrative and descriptive purposes only and should not be construed to limit the scope of the invention. The various interfaces, computer languages, and audio outputs for the illustrative system should be readily apparent to those of ordinary skill.

The foregoing has been a detailed description of illustrative embodiments of the invention. Various modifications and additions can be made without departing from the spirit and scope of this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the parties of the virtual space music collaboration have been largely described as users herein, however a client of the system can comprise any computer or computing entity, or other individual, capable of manipulating the provided interface to enable the system to perform the musical collaboration. Additionally, the positioning, layout, size, shape and colors of each screen display are highly variable and such modifications are readily apparent to one of ordinary skill. Accordingly, this description is meant to be taken only by way of example, and not to otherwise limit the scope of this invention.

What is claimed is:

1. A system for collaborative music making in virtual space comprising:

a client application respectively associated with each of a plurality of clients for combining musical choices of at least some of the plurality of clients, wherein the plurality of clients includes a local client and at least one remote client;

a system server operatively connected to each client application to receive a position data and an audio data from each of the local client and the at least one remote client to combine the musical choices of at least the local client and the at least one remote client relative to the position data of the local client and the remote client;

a graphical interface generated by at least one of the client applications or the system application, the graphical interface providing each of the plurality of clients with opportunities to make musical choices by adjusting the parameters of pre-recorded or computer generated sounds locally, or by navigating through virtual space to adjust the parameters of sounds emanating from remote entities; and a collaborative musical mix generated from the position data and the audio data received for each of the plurality of clients of the virtual space.

2. The system as set forth in claim 1 wherein the graphical interface shows a proportional position of the local client.

3. The system as set forth in claim 1 wherein the graphical user interface shows a proportional position with respect to the remote client.

4. The system as set forth in claim 1 wherein the client application is running on the system server.

5. The system as set forth in claim 1 wherein the client application is running on a local computer of the local user.

6. The system as set forth in claim 1 wherein the client application is split between the system server and a local computer of the local user.

7. The system as set forth in claim 1 which ignores synchronicity between remote users but retains a sense of co presence by adjusting the volume and pan of looped samples that are kept in time by the local client.

8. The system as set forth in claim 1 wherein the local client retains data pertaining to a musical mix to be played back at a later time and can be used to produce a digital audio file that is played outside of the collaborative music making.

9. The system as set forth in claim 8 wherein the digital audio file can be used to generate a graphical representation of the musical mix that the local user can use to repeat the performance of at least a portion of the musical mix using a mixer.

10. A method for combining the musical choices of multiple users into a musical mix comprising the steps of:

receiving a position data and an audio data from each of a plurality of users in a virtual space, each of the plurality of users employing a client application for making musical choices that alter the musical mix, wherein the plurality of users include at least a local user and at least one remote user; and generating the musical mix based upon the position data and the audio data for each of the plurality of users of the virtual space.

11. The system as set forth in claim 10 further comprising the step of providing the position data and the audio data from each of the plurality of users to a system server that stores the position data and the audio data, and combines the position data and the audio data for each of the plurality of users into the musical mix.

* * * * *